US009532595B2

(12) United States Patent
Kaljura et al.

(10) Patent No.: US 9,532,595 B2
(45) Date of Patent: Jan. 3, 2017

(54) SMOKING ARTICLE

(71) Applicant: British American Tobacco (Investments) Limited, London (GB)

(72) Inventors: Karl Kaljura, London (GB); Philip Russell Fawcus, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/429,678

(22) PCT Filed: Sep. 30, 2013

(86) PCT No.: PCT/GB2013/052534
§ 371 (c)(1),
(2) Date: Mar. 19, 2015

(87) PCT Pub. No.: WO2014/053812
PCT Pub. Date: Apr. 10, 2014

(65) Prior Publication Data

US 2015/0245653 A1 Sep. 3, 2015

(30) Foreign Application Priority Data

Oct. 5, 2012 (GB) ..... 1217893.5

(51) Int. Cl.
*A24D 3/04* (2006.01)
*A24D 1/02* (2006.01)

(52) U.S. Cl.
CPC ..... *A24D 3/041* (2013.01); *A24D 1/027* (2013.01); *A24D 3/043* (2013.01)

(58) Field of Classification Search
CPC ..... A24D 1/027; A24D 3/041; A24D 3/043
See application file for complete search history.

(56) References Cited

U.S. PATENT DOCUMENTS 4,687,009 A 8/1987 Nichols
4,699,158 A 10/1987 Sprinkel, Jr.
4,700,725 A 10/1987 Geiszler, Jr.
(Continued)

FOREIGN PATENT DOCUMENTS

EP 0105682 A1 4/1984
EP 0228211 A1 7/1987
(Continued)

OTHER PUBLICATIONS

International Search Report and Written Opinion, mailed Mar. 21, 2014 for PCT/GB2013/052534, filed Sep. 30, 2013.
(Continued)

*Primary Examiner* — Michael H Wilson
*Assistant Examiner* — Dionne Walls Mayes
(74) *Attorney, Agent, or Firm* — Cantor Colburn LLP

(57) ABSTRACT

A smoking article, a smoking article assembly, a blank for forming a smoking article, and a method of manufacturing a smoking article. A smoking article comprising one or more rod articles, an inner layer extending around the rod articles, and an outer layer extending around the inner layer. The inner and outer layers are integrally formed. The outer layer comprises a selection portion configured to move over an underlying part of the inner layer to select a property of the smoking article.

22 Claims, 4 Drawing Sheets

(56) References Cited

U.S. PATENT DOCUMENTS

| | | | |
|---|---|---|---|
| 4,809,718 | A | 3/1989 | Deal |
| 2011/0232663 | A1 | 9/2011 | Kadiric et al. |

FOREIGN PATENT DOCUMENTS

| | | | | |
|---|---|---|---|---|
| EP | 2368448 | A1 | | 9/2011 |
| EP | 2532257 | A1 | | 12/2012 |
| WO | 2006027437 | A1 | | 3/2006 |
| WO | 2011121328 | A2 | | 10/2011 |
| WO | 2011131465 | A1 | | 10/2011 |
| WO | WO2011/21327 | | * | 10/2011 |

OTHER PUBLICATIONS

International Preliminary Report on Patentability, mailed Oct. 31, 2014 for PCT/GB2013/052534, filed Sep. 30, 2013.

* cited by examiner

SMOKING ARTICLE

CLAIM FOR PRIORITY

This application is the National Stage of International Application No. PCT/GB2013/052534, filed Sep. 30, 2013, which in turn claims priority to and benefit of United Kingdom Patent Application No. GB1217893.5, filed Oct. 5, 2012. The entire contents of the aforementioned applications are herein expressly incorporated by reference.

TECHNICAL FIELD

Embodiments of the invention relate to a smoking article, a smoking article assembly, a blank for forming a smoking article, and a method of manufacturing a smoking article.

BACKGROUND

U.S. Pat. No. 4,699,158 describes a smoking article in which a ventilation can be modified by rotation of a part of the smoking article.

SUMMARY

An embodiment of the invention provides, in a first aspect, a smoking article comprising: one or more rod articles, an inner layer extending around the rod articles, an outer layer extending around the inner layer, wherein the inner and outer layers are integrally formed, and wherein the outer layer comprises a selection portion configured to move relative to an underlying part of the inner layer to select a property of the smoking article.

An embodiment of the invention provides, in a second aspect, a smoking article assembly for forming two smoking articles, comprising: rod articles for forming the smoking articles, an inner layer extending around the rod articles, an outer layer extending around the inner layer, wherein the inner and outer layers are integrally formed, and wherein the outer layer comprises a selection portion for each smoking article configured to move over an underlying part of the inner layer to select a property of the smoking article, and wherein the smoking article assembly is configured to be cut into two separate smoking articles.

An embodiment of the invention provides, in a third aspect, a blank for wrapping around one or more rod articles to form a smoking article, the blank comprising: a first area for forming an inner layer extending around the rod articles, a second area for forming an outer layer extending around the inner layer, wherein the first and second areas are integrally formed, and wherein the second area defines a selection portion configured to move over an underlying part of the inner layer to select a property of the smoking article.

An embodiment of the invention provides, in a fourth aspect, a method of manufacturing a smoking article comprising: providing one or more rod articles, wrapping a blank around the rod articles, wherein the blank is wrapped to form an inner layer extending around the rod articles, and the blank is further wrapped to form an outer layer extending around the inner layer such that the inner and outer layers are integrally formed, wherein the outer layer comprises a selection portion configured to move over an underlying part of the inner layer to select a property of the smoking article.

An embodiment of the invention provides, in a fifth aspect, a smoking comprising: one or more rod articles, an inner layer extending around the rod articles, an outer layer extending around the inner layer, the smoking article comprises a limiter to limit movement between the inner layer and the outer layer, and the limiter comprises a slot defined by one of the inner and outer layers, and a limiter element moveable within the slot to limit movement, the smoking article further comprising a ventilation area defined by the other of the inner and outer layers from the layer defining the slot, wherein the ventilation area is movable relative to the slot, such that an area of overlap of the slot and ventilation area controls a ventilation of the smoking article.

BRIEF DESCRIPTION OF THE DRAWINGS

Various embodiments of the invention will now be described, by way of example only, with reference to the accompanying drawings, in which.

DETAILED DESCRIPTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products (i.e. products in which flavour is generated from a smoking material by the application of heat without causing combustion of the material).

A smoking article formed by an embodiment of the apparatus or method comprises an elongate source of smokable material. In particular, the smokable material is tobacco, and is arranged in a cylindrical tobacco rod. One or more filters or filter sections are attached to the tobacco rod. The filter or filter sections define a longitudinal axis, which is common to a longitudinal axis of the tobacco rod. As used herein, the term "component of a smoking article" includes any component part of a smoking article such as a tobacco rod, filter, filter section, or a combination of these. One or more components of the smoking article are circumscribed by a wrap. The wrap can have the function of one or more of: connecting two components, providing structural support to one or more components, allowing movement relative to another part of the smoking article to control a property of the smoking article (e.g. ventilation), or any other function.

Figure 1:
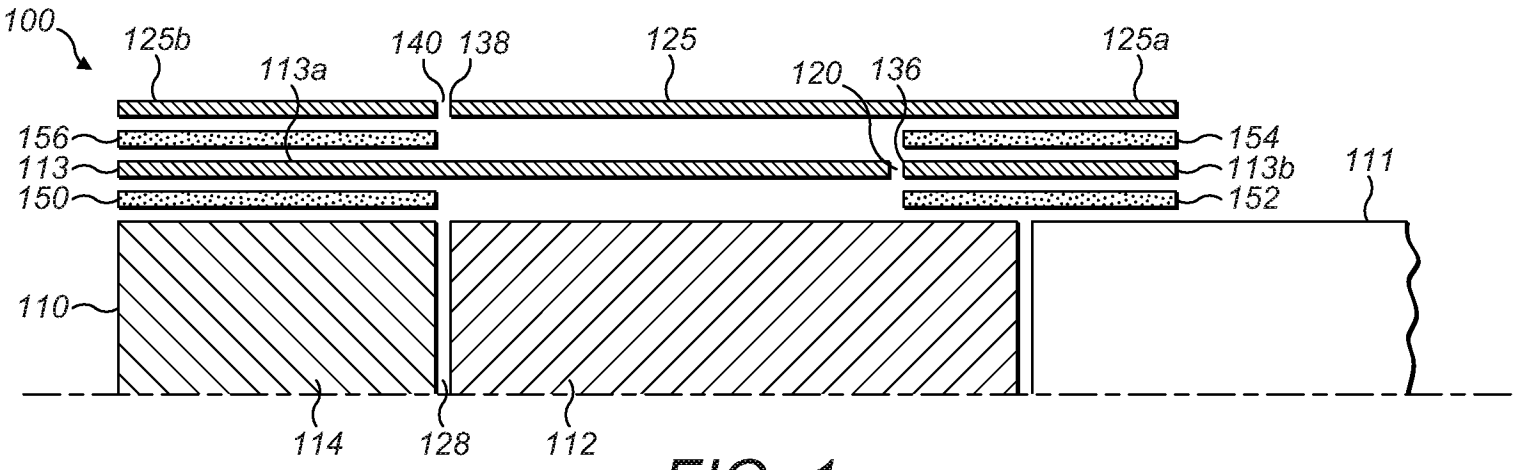
FIG. 1 is a partial longitudinal cross-section of a smoking article according to the invention.

FIG. 1 shows an exemplary smoking article 100, which may be manufactured according to an embodiment of the apparatus or method. This smoking article is merely an example, and the apparatus and method may be used in the manufacture of different types of smoking articles having a first wrapped layer, and a second wrapped layer circumscribing the first wrapped layer.

The smoking article 100 comprises a first part comprising a source of smokable material 111. In this example, the smokable material is tobacco, in the form of a tobacco rod. The smoking article 100 further comprises one or more filter sections attached to the source of smokable material in. The exemplary smoking article comprises a part movable to select a property of the smoking article e.g. a ventilation level. In this example, the movement is a rotation. In some implementations, the smoking article optionally comprises a limiter (limiting mechanism), configured to limit movement to a pre-determined range.

The smoking article comprises a first filter section 112 and a second filter section 114. The first filter section 112 is attached to the source of smokable material to form a single unit. The tobacco rod and first filter section 112 may be connected with a covering layer to affix the first filter section 112 to the tobacco rod, for example formed of sheet material, e.g. tipping paper, as is known. The tobacco rod and first filter section are referred to as a first part of the smoking article, or as a tobacco unit. The elongate tobacco rod and first filter section define a longitudinal axis of the smoking article. A downstream (or rearward) direction is defined towards a mouth end of the smoking article. An upstream (or forward) direction is defined towards a lighting end, or tobacco rod, of the smoking article.

A second part of the smoking article comprises the second filter section 114. The second filter section 114 is co-axial with the first filter section 112, and is located rearwardly of the first filter section 112. The tobacco rod, first filter section 112 and second filter section 114 can be considered as examples of rod articles 110 or a "core" of the smoking article, around which an inner wrap and an outer wrap are wrapped. The smoking article may be formed with one or more rod articles.

The first and/or second filter sections 112,114 may be made of a conventional filtration material, e.g. cellulose acetate tow. The first and/or second filter sections 112,114 further comprises a sheet material, for example paper, e.g. plugwrap, which is wrapped around the filtration material. The filtration material and surrounding wrapped sheet material forms an example of a rod article. The inner and outer wraps described are separate and additional to the sheet material wrapped directly around the filtration material or tobacco material, and forming the filter rods or tobacco rod. The first filter section 112 is separate to the second filter section 114, separated at an interface 128.

The smoking article 100 comprises an inner wrap 113, in the form of a sleeve. The inner wrap 113 is a cylindrical tube, extending around the circumference of the tobacco rod in, first filter section 112 and/or second filter section 114. The inner wrap 113 is formed from a first blank of sheet material. The inner wrap 113 forms part of the second part of the smoking article. The tobacco rod and first filter section are dimensioned to rotate as a unit around a longitudinal axis within the inner wrap 113. The inner wrap is also termed the inner layer.

The inner wrap is optionally formed with a separation line 136 which extends substantially circumferentially. The separation line 136 is a frangible connection, for example, in the form of a perforation line. The material of the inner wrap is configured to easily break along the separation line 136 into a rearward part 113*a* and a forward part 113*b* to allow relative rotation of the first and second parts of the smoking article. Once the separation line 136 broken, a first interface 120 is formed between the rearward part 113*a* and forward part 113*b*.

The smoking article 100 further comprises an outer wrap 125. The outer wrap 125 extends around the circumference of the inner wrap 113. The outer wrap 125 is in the form of a cylindrical tube. The outer wrap 125 is formed from a second blank of sheet material. The outer wrap 125 forms part of the first part of the smoking article. The outer wrap is also termed the outer layer.

In some embodiments, the material forming the outer wrap 125 includes a separation line 138, which extends substantially circumferentially. The material of the outer wrap 125 comprises a frangible connection, which is configured to easily break along the separation line 138 into a forward part 125*a* and a rearward part 125*b*. The forward part 125*a* is affixed to the first part of the smoking article, and may be a component of the first part of the smoking article which is rotatable relative to the second part as described for the outer wrap 125 above. Once the separation line 138 broken, a second interface 14 is formed between the rearward part 125*b* and forward part 125*a*.

The rearward part 113*a* may be affixed to the second filter 114 by a first connection area 150. The forward part 113*b* may be affixed to the first filter 112 and/or tobacco rod 11 by a second connection area 152.

The forward part 125*a* may be affixed to the first part of the smoking article by a third connection area 154. In particular, the third connection area 154 may connect the forward part 125*a* of the outer wrap 125 to the forward part 113*b* of the inner wrap 113. The rearward part 125*b* of the outer wrap may be affixed to the inner wrap 113 by a fourth connection area 156.

The first, second, third and fourth connection areas 150, 152,154,156 comprise adhesive to adhere the adjacent layers together. In some aspects, the inner and outer wraps comprise one or more further areas of adhesive to connect the inner and outer wraps and/or inner wrap and rod articles.

The smoking article may comprise a ventilation system (not shown) configured to allow adjustment of a ventilation of the smoking article. The ventilation system may include one or more ventilation areas, which in turn include ventilation apertures and/or air permeable material, in one or each of the first part and second part. For example, when ventilation areas in the inner layer and/or outer layer of sheet material around the first and/or second filter sections are aligned or overlap, air can flow into the body of the first and/or second filter section. The ventilation is selected by selecting a position of the second part relative to the first part to determine an amount of overlap of the ventilation areas.

The embodiment described is an example only of a smoking article having an inner layer and an outer layer around one or more rod articles. The inner and/or outer layers may be configured differently, with less or more separation lines or adhesive areas. The outer wrap is at least partially arranged around the inner wrap, such that at least part of the inner wrap is radially within the outer wrap. The inner and outer wraps are generally tubular, and in particular, cylindrical.

Figure 2:
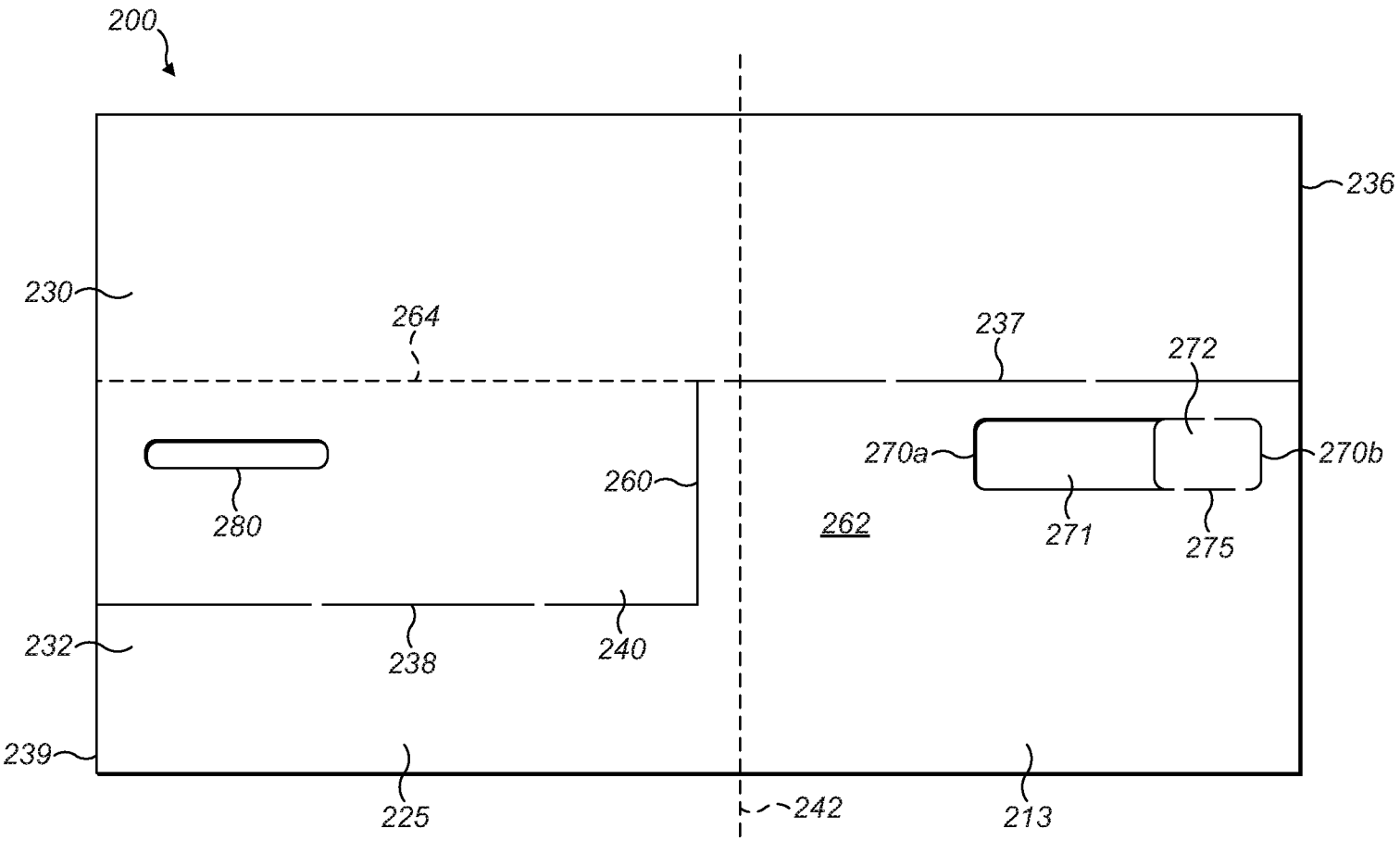
FIG. 2 is a plan view of a blank according to a first embodiment of the blank.

FIG. 2 shows a blank 200 for forming a smoking article. The blank 200 forms the inner layer 113 and the outer layer 125 of the smoking article 100. The blank 200 is wrapped twice around the rod articles, such that the inner layer and outer layer are integrally formed, as will be explained.

The blank 200 comprises an inner layer area 213, or a first area, arranged to form the inner layer of a smoking article. An edge 236 of the blank is arranged to be attached to the one or more rod articles, and wrapped around to circumscribe the rod articles. As shown, the vertical edge 236 at the right is aligned with a longitudinal axis of the rod articles, and attached to the rod articles. The inner layer area 213 has a length to extend around the whole circumference of the rod articles. The length of the inner layer area is shown as the length extending horizontally from the edge 236 to the line 242. The line 242 is merely for illustration, and the blank is not broken or perforated along the line 242.

The blank 200 further comprises an outer layer area 225, or a second area, arranged to form the outer layer of the smoking article. The outer layer extends around the inner layer, and hence also around the rod articles. The outer layer area extends from the line 242 to the edge 239 of the blank, which is at an opposite end of the blank to the edge 236. The outer layer area 225 has a length to extend around the whole circumference of the rod articles and inner layer.

The inner layer area 213 and outer layer area 225 are integrally formed on the blank. Thus, the inner and outer layers are integrally formed. The blank is arranged to be wrapped twice around the rod articles to form the inner and outer wraps.

The outer layer area 225, and optionally the inner layer area 213 also, is configured to define a forward part 230 and a rearward part 232. In particular, both inner layer area and outer layer area define a forward part 230 and a rearward part 232. The blank 200 is arranged to split both the inner layer area and the outer layer area into a forward part and a rearward part, which are rotatable relative to each other in the smoking article.

The blank 200 comprises a portion 240 which is a part of, i.e. integrally formed with, the forward part of the outer layer. The portion 240 is termed a selection portion 240 for convenience. The selection portion 240 is configured to rotate over the inner layer. The selection portion 240 defines an outer interface 238 between the forward and rearward parts of the outer layer 225. The further boundaries of the selection portion 240 are defined below.

The blank 200 further defines an inner interface 237 between the forward and rearward parts 230,232 of the inner layer 213. The inner interface 237 and outer interface 238 each extend substantially circumferentially when the blank 200 is wrapped around the rod articles. The inner interface 237 is longitudinally spaced from the outer interface 238, and in particular, is forward of the outer interface 238. The inner wrap area 213 underlying the selection portion 240 is a part of, i.e. integrally formed with, the rearward part 232.

The inner and outer interfaces 237,238 are connected by a selection portion interface 260. The selection portion interface 260 extends substantially longitudinally (when wrapped) between the inner interface and the outer interface. The selection portion interface 260 forms a break substantially between the inner and outer layer, such that the inner and outer layer are separable over the longitudinal extent of the selection portion interface 260. Thus, the selection portion 240 of the outer layer is rotatable directly over an underlying area 262 of the inner layer. The inner and outer layers forward and/or rearward of the selection portion remain integrally formed. The selection portion 240 extends longitudinally over the longitudinal extent of the selection portion interface 260. A longitudinally forward edge of the selection portion 240 is illustrated by a circumferential line 264 between edge 239 and the selection portion interface 260. The selection portion 260 is integral with the blank 200 forward of the line 264, and the line 264 is for illustration purposes only and does not represent a feature of the blank 200.

The selection portion interface 260 is located on the outer layer, adjacent and spaced from the inner layer. The underlying area 262 extends around the whole circumference of the rod articles. Additionally, the underlying area 262 extends a short distance as the outer wrap, between the line 242 and the selection portion interface 260. The outer wrap of the underlying area is affixed (e.g. by adhesive) to the overlapping underlying layer. This overlap secures the underlying area 262 as a cylinder around the rod articles. The underlying area 262 is defined as the integral part of the inner wrap which underlies the selection portion 240, i.e. aligned and having the same longitudinal extent as the selection portion interface 260.

The outer wrap 225, including the selection portion 240, extends around the whole circumference of the inner wrap. In addition, the outer wrap 225 and selection portion 240 extend further circumferentially to form an overlap, affixed to the overlapped selection portion to secure the outer wrap 225 and selection portion as a cylinder.

The inner interface 237, outer interface 238 and selection portion interface 260 are configured to be formed in the single piece of sheet material forming the blank 200. The blank 200 is configured such that the forward and rearward parts 230,232 are initially connected. The inner interface 237, outer interface 238 and selection portion interface 260 initially are not separated by a break in the blank 200. The blank 200 is configured to separate on application of a force, e.g. preferentially break along the inner interface, outer interface and selection portion interface 260. In particular, the inner interface 237, outer interface 238 and selection portion interface 260 are formed by a frangible connection in the sheet material. For example, the frangible connection is a perforation line in the sheet material of the blank 200. The parts of the blank 200 are integrally formed, and configured to separate along the frangible connections to form separate forward and rearward parts when an external force is first applied to rotate the selection portion.

The blank of any embodiment comprises a sheet material. The sheet material can be formed of paper (e.g. tipping paper), or a plastics or polymer material. In particular, the sheet material can be regenerated cellulose or regenerated cellulose acetate. The regenerated cellulose acetate can be cast regenerated cellulose acetate. In some examples, the sheet material is a laminate of any two (or more) materials. For example, the sheet material is a laminate of any of paper (e.g. tipping paper), a plastics material, polymer material, regenerated cellulose, regenerated cellulose acetate, or cast regenerated cellulose film. In particular, the sheet material is a laminate of paper and regenerated cellulose. Any sheet material of the smoking article can comprise any of the types of sheet material described.

The smoking article may optionally comprise a limiter (limiting mechanism) configured to limit movement between the first and second parts of the smoking article when assembled, i.e. limit rotational movement of the selection portion 240. The limiting mechanism is configured to limit rotation to a pre-determined range. In some embodiments, the pre-determined range of rotation may be through an angle of from about 90 to 180 degrees, and can be, for example, approximately 120 degrees. The limiting mechanism can limit rotation between a position in which the first and second ventilation areas have no overlap, and a further position in which the first and second ventilation areas are in full overlap.

The limiting mechanism comprises engaging parts on the inner wrap 213 and outer wrap 225, which engage between the inner wrap 213 and outer wrap 225. Thus, the limiting mechanism is configured to limit movement between the first and second parts of the smoking article to a predetermined range, which in some examples is by limiting movement between the inner wrap 213 and outer wrap 225.

The limiting mechanism comprises a first contact surface 270*a* and a second contact surface 270*b*. The first contact surface 270*a* and second contact surface 270*b* are configured to engage with a stop 272 to limit the range of movement in a first and second direction respectively. The first and second contact surfaces 270*a*, 270*b* are at opposite ends of a window or slot 271. The slot 271 is formed as a cut-out from the blank 200, in the inner layer area 213.The slot 271 is an aperture in the material of the inner layer.

The stop 272 is attached to one or more of the outer wrap area 225 and rod articles 110, when the blank 200 is wrapped around the rod articles. The stop 272 is moveable within the slot 271 to limit movement between the first and second parts of the smoking article (forward and rearward parts 230,232 of the blank 200). The first contact surface 270*a* and the second contact surface 270*b* are circumferentially spaced to limit rotation, i.e. the slot 271 extends circumferentially. In some examples, the stop 272 and first and second contact surfaces 270*a*, 270*b* have engaging edges which are complementary, i.e. match to engage simultaneously across their width. For example, the first and second contact surfaces 270*a*, 270*b* and engaging edges of the stop 272 extend perpendicularly to the axis of the slot 271, i.e. parallel to the axis of the smoking article. The stop 272 may have a substantially square or rectangular area.

In the example shown, the slot 271 is in the form of an aperture extending circumferentially through the sheet material of the inner layer area 213 of the blank 200, which when wrapped, overlies the first filter section 112.

The selection portion 240 is configured to move relative to the underlying area 262 to control a property of the smoking article. In some aspects, the selection portion 240 is rotatable relative to the underlying part, around a longitudinal axis of the rod articles. The property controlled is a ventilation of the smoking article. For example, the rotational position of the selection portion controls an area of one or more ventilation area or aperture 280 which are aligned with a further ventilation area or aperture to allow ingress of ventilating air. In particular, the aperture 280 is selectively alignable with the slot 271 in the inner layer area, in which the stop is movable. The ventilation aperture 280 is variably covered by the underlying area 262 of the inner layer to block the ventilation aperture 280, and prevent ingress of air. The aperture 280 and the slot 271 are movable relative to each other, and the amount of overlap of the aperture 280 and the slot 271 in the different layers determines the level of ventilation. The aperture 271 has the dual function of providing the first contact surface 270*a* and the second contact surface 270*b* as part of the limiting mechanism, and also controls a level of ventilation by allowing ventilating air through the inner layer dependent on alignment with the second ventilation area 280.

The stop 272 is affixed to the outer layer, and does not determine the level of ventilation. Optionally, an underlying rod article comprises a further ventilation aperture or a porous outer wrap. Alternatively or in addition, the selection portion controls a different property of the smoking article, e.g. a flavourant release.

In some examples, the stop 272 is affixed to an interior of the outer wrap 125 when wrapped, which corresponds to the outer wrap area 225. In particular, the stop is affixed to the selection portion 240. The stop 272 forms a protrusion, extending radially into the slot 271.

In some examples, the stop 272 is initially formed as a part of one of the inner wrap area 213, outer wrap area 225 or rod articles. In particular, the stop 272 is initially formed as part of, i.e. integrally formed with, the inner wrap area 213. The area of sheet material of the blank 200 for forming the stop 272 is separable from the remainder of the blank 200 along a separation line 275, for example, by perforations formed in the material of the blank 200. The slot 271 is formed adjacent the area of sheet material for forming the stop 272, in the same one of the inner layer or outer layer in which the stop 272 is formed. The area of sheet material of the inner wrap for forming the stop may be affixed to one or more adjacent layers, in particular, to one or both of the outer layer or tobacco unit. For example, the stop 272 may be affixed to the adjacent layer(s) by adhesive. The stop 272 is formed from the same layer of material as the slot and first and second contact surfaces, i.e. the same one of the inner wrap area 213, outer wrap area 225 or rod articles. On an initial movement between the inner and outer wraps of the smoking article, the area of sheet material forming the stop 272 is urged towards the slot 271, separating that area of sheet material from the remainder of the inner wrap, and forming a distinct movable stop 272.

The first contact surface 270*a* is initially formed as an edge of the slot 271. The second contact surface 270*b* is defined by the separation line 275. The stop 272 is formed with edges which are complementary to the first and second contact surfaces 270*a*, 270*b*, for example, having rounded edges as shown.

Alternatively, the slot 271 is formed in the outer layer area 225. The stop 272 is also formed in the outer layer area 225, and affixed to the inner layer area when the blank is wrapped around the rod articles. Generally, the slot 271 can be formed in either of the inner or outer layers to limit movement of the inner layer relative to the outer layer. This applies to the limiter of any embodiment.

The smoking article further comprises an indexer (indexing mechanism) configured to provide for indexing of movement of the selection portion 240 relative to the underlying area 262. One or more pawls (not shown) are affixed to an interior surface of the inner layer area during manufacture, in particular, to part of the inner layer area movable relative to the selection portion, e.g. forward part 332*b*. The pawl is one or more upstanding protrusions arranged to releasably engage with a plurality of discrete features to form the indexer. The pawl is configured to engage with features (e.g. ridges) on an exterior of the rod articles, to provide indexing on rotation between the inner wrap and at least one of the rod articles, in particular, the first filter section 112.

Figure 3:
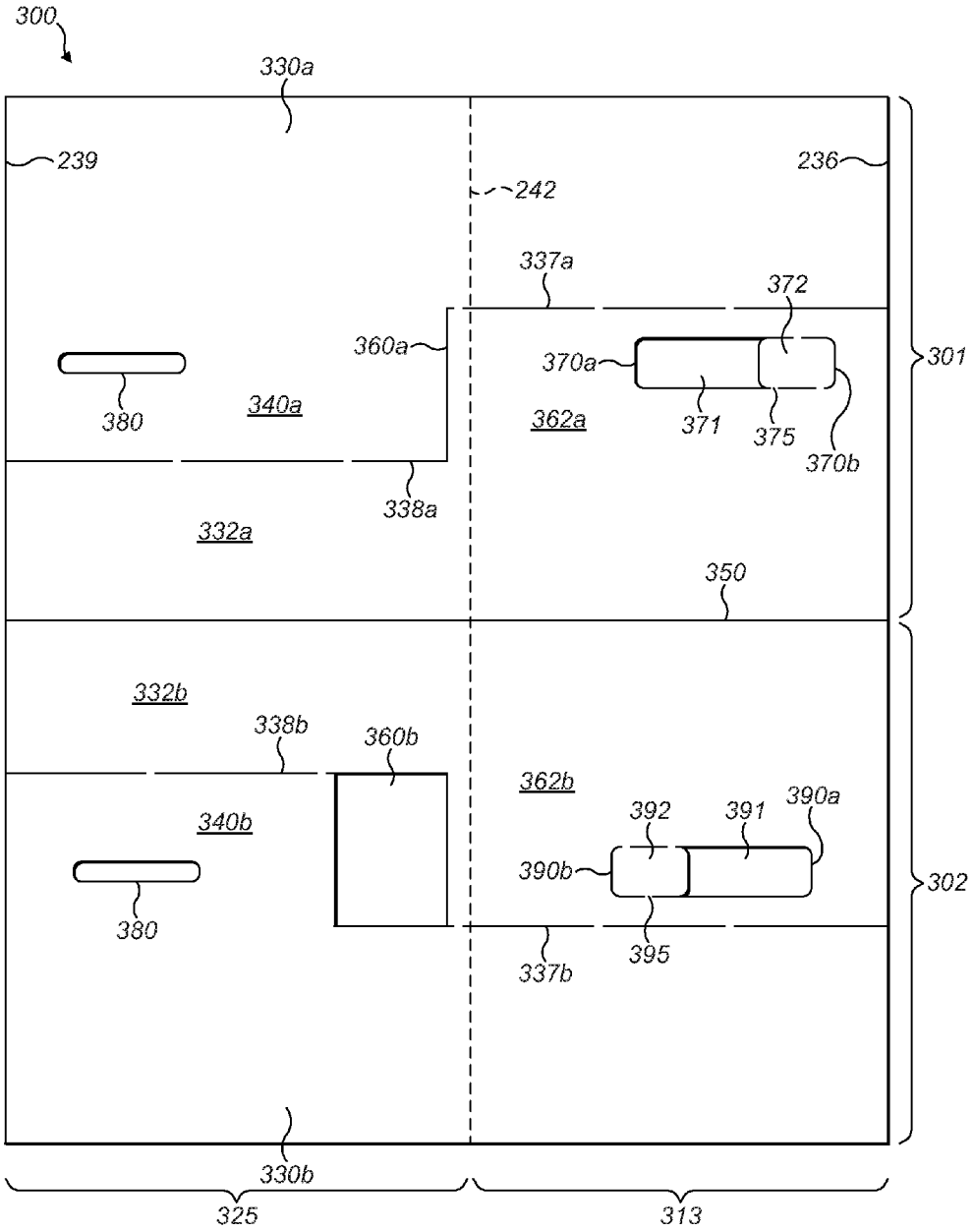
FIG. 3 is a plan view of a blank according to a second embodiment of the blank.

FIG. 3 is a plan view of a blank 300 according to a second embodiment of the invention. The blank 300 is configured to form an inner layer and an outer layer for a plurality of smoking articles, in particular, two smoking articles. The blank 300 is arranged to be cut along a cut line 350 to split the blank into a first section 301 and a second section 302, one section for each smoking article. Each of the sections 301,302 has the functions described above.

The blank 300 forms the inner layer 113 and the outer layer 125 of the smoking article 100. The blank 300 is wrapped twice around the rod articles, such that the inner layer and outer layer are integrally formed, as described above.

The blank 300 comprises an inner layer area 313, or first area, arranged to form the inner layer of the two smoking articles. An edge 236 of the blank is arranged to be attached to the one or more rod, as described above. The length of the inner layer area 313 is shown as the length extending horizontally (relating to a circumferential extent) from the edge 236 to a line 242, as described above.

The blank 300 further comprises an outer layer area 325, or second area, arranged to form the outer layer of the smoking articles. The outer layer area 325 extends from the line 242 to an edge 239 of the blank, as described above. The inner layer area 313 and outer layer area 325 are integrally formed on the blank 300, as described above.

The outer layer, and optionally the inner layer also, is configured to define a forward part 330*a*,330*b* on the first and second sections respectively, and a rearward part 332*a*, 332*b* on the first and second sections respectively. In particular, both inner layer and outer layer define a forward part and a rearward part, on each of the first and second sections 301,302. The blank 300 is arranged to split both the inner layer area and the outer layer area into the forward parts 330*a*,330*b* and the rearward parts 332*a*, 332*b*.

The rearward parts 332*a*,332*b* of the first and second sections 301,302 of the blank are adjacent. As such, the rearward, or mouth end, of the smoking articles are formed together. In particular, a rod article wrapped by the blank at the rearward end of the smoking articles is a filter rod. In some examples, a single filter rod is wrapped by both the first and second sections 301,302 of the smoking article.

The blank 300 comprises a first selection portion 340*a* on the first section 301, and a second selection portion 340*b* on the second section 302. The blank 300 is configured such that at least the first and second selection portions 340*a*,340*b* of the outer layer rotate over the inner layer, on the first and second sections respectively. The selection portions 340*a*, 340*b* are integrally formed with the forward parts of the outer layer. The selection portions 340*a*, 340*b* define a radially outer interface 338*a*, 338*b* between the forward and rearward parts of the outer layer, for each section 301,302 of the blank. The selection portions 340*a*,340*b* are configured to move over an underlying part 362*a*, 362*b* of the inner layer 313 to select a property of the smoking article. The outer interfaces 338*a*, 338*b* correspond to the second interface 140, as described above.

The blank 300 further defines radially inner interfaces 337*a*, 337*b* between the forward and rearward parts of the inner layer, on the first and second sections respectively, as described with respect to the first interface 120, substantially as described above.

The inner and outer interface are connected by a first and second selection portion interfaces 360*a*, 360*b* on the first and second sections respectively, substantially as described above for the selection portion interface 260.

The first selection portion interface 360*a* extends as a line with substantially no width, e.g. extending longitudinally with substantially zero circumferential extent. The first selection portion interface 360*a* is a break between immediately adjacent parts of the blank. The first selection portion interface 360*a* can be formed as a frangible connection, e.g. a perforation line. The first selection portion interface 360*a* allows movement of the first selection portion to increase the extent of the first selection portion interface 360*a*. The first selection portion interface 360*a* does not allow movement in the opposite direction, since the selection portion abuts against the adjacent part of the outer layer also defining the first selection portion interface 360*a*.

The second selection portion interface 360*b* is a cut-out area of the blank 300. The cut-out area is formed prior to wrapping the blank around the rod articles. The cut-out area defines an aperture in the material of the blank 300 prior to application of a force to separate the further interfaces. The second selection portion interface 360*b* is an area which extends circumferentially (when wrapped) and longitudinally. In particular, the cut-out area extends in two-dimensions. The area of the blank forming the second selection portion interface 360*b* is removed from the blank 300. The cut-out area can be rectangular as shown.

The circumferential extent of the second selection portion interface 360*b* allows movement of the selection portion in a direction which reduces the circumferential extent of the second selection portion interface 360*b*. Thus, movement in both directions is allowed by the second selection portion interface 360*b*. In particular, the cut-out is arranged such that the selection portion of each of the two smoking articles is rotatable in a same sense on the two separated smoking articles. Thus, the direction of operation of the two smoking articles is the same. The cut-out area is configured to allow rotation of a portion of the outer layer relative to the inner layer of the second section 302, in a direction reducing the extent of the cut-out, over a range to control a property of the smoking article. For example, a functional range of movement of the second section 302 in a direction reducing the extent of the cut-out is the same as a functional range of the first section 301.

The blank 300 further comprises a limiter (limiting mechanism) for each section, configured to limit rotational movement of each selection portion. The limiter on each section 301,302 is substantially as described above, and can have any of the features described above.

The first section 301 comprises a first engaging element 372 movable in a first slot 371 having ends 370*a*,370*b*. The area of sheet material of the blank 300 for forming the stop 372 is frangible connected, i.e. separable, from the remainder of the blank 300 along a separation line 375. For example, the frangible connection is by perforations formed in the material of the blank 300. The first engaging element 372 is initially at the end 370*b* of the slot 371, shown as the right of the first slot. When wrapped around the rod articles, the first engaging element 372 is rotatable in an anti-clockwise direction from the initial position along the first slot, as viewed from a mouth end of the smoking article. This movement increases the extent of the first selection portion interface 360*a*.

The second section 302 comprises a second engaging element 392 movable in a second slot 391 having ends 390*a*,390*b*. The slots 371,391 are apertures in the material of the inner layer. The area of sheet material of the blank 300 for forming the stop 392 is separable from the remainder of the blank 300 along a separation line 395, for example, by perforations formed in the material of the blank 300. The second engaging element 392 is initially at an end of the second slot 390*b*, shown as the left of the second slot. When wrapped around the rod articles, the second engaging element 392 is rotatable in an anti-clockwise direction from the initial position along the second slot, as viewed from a mouth end of the smoking article. This movement reduces the extent of the second selection portion interface 360*b*.

The initial circumferential extent of the second selection portion interface 390*b* allows initial movement of the second engaging element 392 along the second slot 391 in the same rotational sense (when wrapped) as the first engaging element 372 along the first slot 371. Thus, smoking articles formed using the first section 301 of the blank and smoking articles formed using the second section 302 of the blank function identically. The cut-out at the second selection portion interface 390*b* provides for manufacturing two smoking articles with a single blank which function identically.

If both of the engaging elements are initially located at the same end of the slot, i.e. the right as shown, movement of both engaging elements increases the circumferential extent of the selection portion interfaces. However, when the two smoking articles are then separated, the movement of the first and second engaging elements would be in different rotational senses.

The cut line 350 indicates the location along which an external cutter (not shown) is arranged to cut during manufacture, and does not indicate a feature on the blank 300. Alternatively, the cut line 350 indicates a feature of the blank along which the blank preferentially separates, e.g. a perforation line.

The smoking articles manufactured using the blank 300 further comprise an indexer (indexing mechanism) configured to provide for indexing of movement of the selection portions, as described above.

The property controlled is a ventilation of the smoking article. For example, the rotational position of the selection portion controls an area of one or more ventilation area or aperture 380 which are aligned with a further ventilation area or aperture to allow ingress of ventilating air. In particular, the aperture 380 is selectively alignable with the slot 371,391 in the inner layer area, in which the stop is movable. The ventilation aperture 380 is variably covered by the underlying area 362*a,b* of the inner layer to block the ventilation aperture 380, and prevent ingress of air. The aperture 380 and the slot 371,391 are movable relative to each other, and the amount of overlap of the aperture 380 and the slot 371,391 in the different layers determines the level of ventilation. The stop 372,392 is affixed to the outer layer, and does not determine the level of ventilation. Optionally, an underlying rod article comprises a further ventilation aperture or a porous outer wrap. Alternatively or in addition, the selection portion controls a different property of the smoking article, e.g. a flavourant release.

An initial ventilation is the same for the two smoking articles produced from the blank 300. The ventilation areas 380,371;380,391 are arranged on the blank 300 such that an initial ventilation with no relative movement between the parts of the smoking article is the same. On relative movement between parts of the smoking article, the ventilation areas 380,371;380,391 are arranged on the blank 300 such that ventilation varies in the same manner for the two smoking articles produced from the blank 300.

Figure 4:
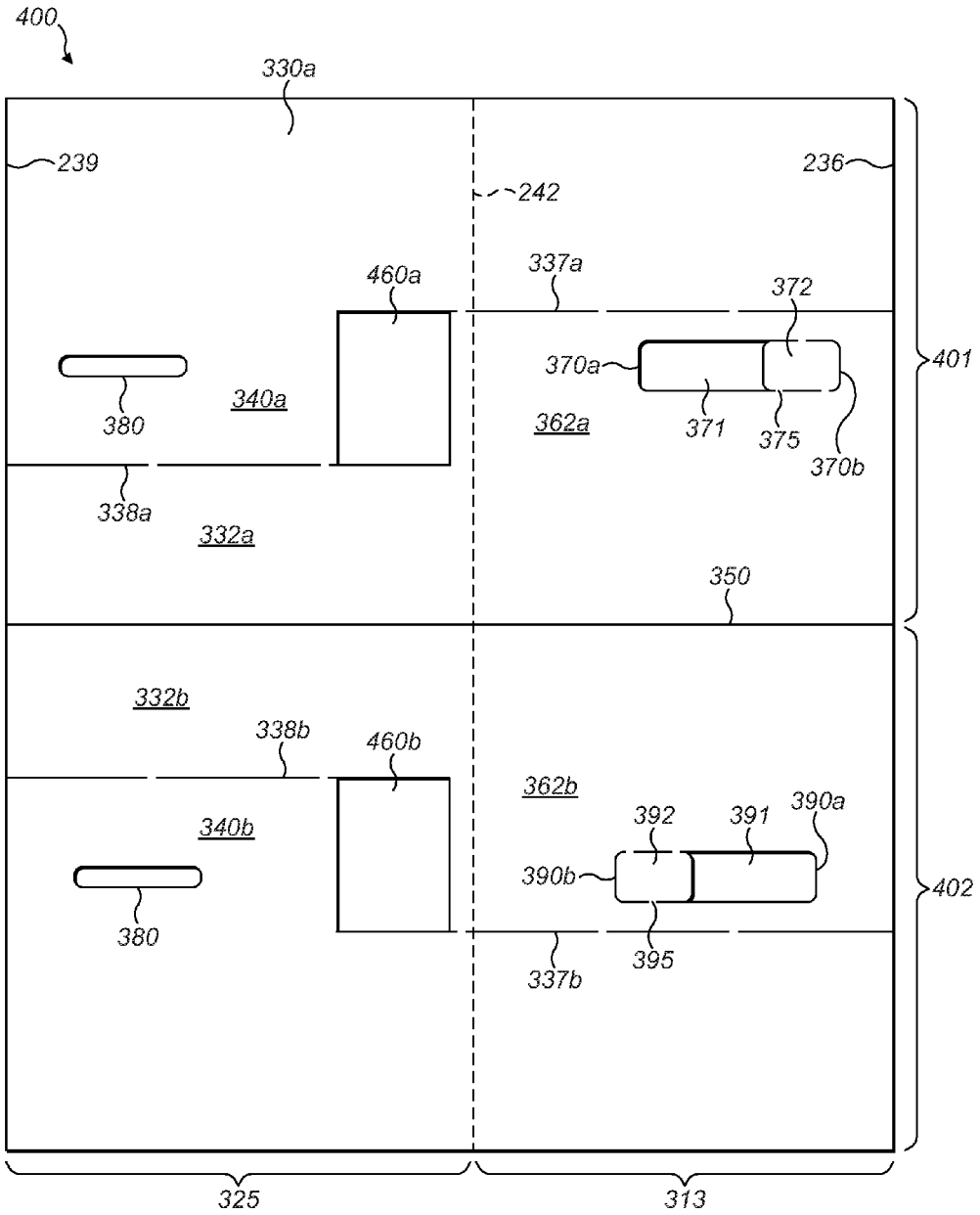
FIG. 4 is a plan view of a blank according to a third embodiment of the blank.

FIG. 4 shows a third embodiment of a blank 400. The blank 400 is configured similarly to FIG. 3, and the same reference numerals indicate the same features. The blank 400 defines a first section 401 and a second section 402, each configured to form part of separate smoking articles, as described with respect to FIG. 3. The limiter is the same as described with respect to FIG. 3.

The blank 400 comprises a first and second selection portion interface 460*a*,460*b* which have a circumferential extent when wrapped. A first selection portion interface 460*a* extends both circumferentially and longitudinally, and the second selection portion interface 460*b* extends both circumferentially and longitudinally. The first and second selection portion interface 460*a*,460*b* have substantially the same dimensions. The first and second selection portion interface 460*a*,460*b* are cut-outs from the blank material, as described above.

The dimensions of the first selection portion interface 460*a* do not affect the functioning of the smoking articles compared to the second embodiment shown in FIG. 3. In some examples, the presence of identical selection portion interface 460*a*, 460*b* assists in ensuring that tensions and forces on the blank material are relatively uniform during manufacture.

During manufacture, the blank 200 is wrapped twice around rod articles for forming one smoking article, or the blank 300,400 is wrapped twice around rod articles for forming two smoking articles. The wrapping is carried substantially as described above. After wrapping, the blank 300,400 is cut along the cut line 350 to split the blank 300,400 into a section for each smoking article. In some examples, a rod article extends longitudinally through the cut line 350. The rod article is also cut into two separate sections, one for each smoking article.

Any feature of any embodiment can be used in combination with any other feature from any other embodiment. Details of a feature more fully described in a different embodiment can be incorporated into any other embodiment.

The cut-outs described can be formed by removing an area of the sheet material by any method. Alternatively, the sheet material can be formed initially with the cut-out. The cut-out refers to an aperture in the sheet material, and does not imply a particular method of manufacture.

The embodiments of the invention describe that the slot 271,371,391 of any embodiment has the dual function of limiting rotation and providing ventilation when overlapping with a ventilation area in an adjacent layer. A smoking article, blank or smoking assembly can comprise features of the slot, limiter and/or ventilation system independently of the integral inner and outer layers or cut-out features described. In particular, any inner and outer layer can comprise the slot, limiter and/or ventilation system described. The inner and outer layers can be formed by separate sections of sheet material, which are attached independently to rod articles. Any further feature described can be included in combination the slot, limiter and/or ventilation system, independently of the integral inner and outer layers.

The movement of the selection portions relative to the underlying layer has been described as a rotational movement. Alternatively, the movement is a longitudinal movement, i.e. along a longitudinal axis of the rod articles or smoking articles. Alternatively, the movement is a combination of longitudinal and rotational movement.

The limiter has been described as comprising a stop integrally formed with the inner wrap. Alternatively, the stop comprises a raised protrusion of any type, movable within a slot. For example, the stop is formed by adhesive, forming a raised protrusion. The stop extends radially outwardly from the rod articles, into the slot of any embodiment. In some examples, the stop is connected to both the outer wrap and the rod articles. In an alternative arrangement, the stop extends through the slot in the inner layer, and attaches to both radially adjacent layers, i.e. to both the outer layer and the rod articles forming the first part of the smoking article. The outer wrap and the rod articles form a single unit, between which the inner wrap is rotatable. The stop provides a connection between the outer wrap and the tobacco unit. The stop may be formed only of adhesive, adhered to both the outer wrap and the tobacco unit. The attachment of the stop to both radially adjacent layers means that the stop cannot be moved out of the slot, for example, by a radial deformation of the inner wrap defining the slot. Alternatively, the slot is formed in the outer wrap, and the stop movable within the slot is attached to the inner wrap.

The smoking article has been described as the selection portion moving over an underlying portion to select a property of the smoking article. Alternatively, the underlying portion can be considered as moving under, or relative to, the selection portion.

In order to address various issues and advance the art, the entirety of this disclosure shows by way of illustration various embodiments in which the claimed invention(s) may be practiced and provide for superior smoking articles or manufacturing of smoking. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/ or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article, comprising:

one or more rod articles;

an inner layer disposed around the one or more rod articles; and an outer layer disposed around the inner layer, wherein the inner and outer layers are integrally formed, the outer layer including a selection portion configured to be moved relative to an underlying part of the inner layer to select a property of a smoking article.

2. The smoking article as claimed in claim 1, wherein the selection portion of the outer layer defines a cut-out area adjacent to the inner layer and is configured such that the selection portion is movable towards the inner layer from an initial position.

3. The smoking article as claimed in claim 1, further comprising:

a limiter configured to limit movement of the selection portion, wherein the limiter couples the selection portion to the underlying part of the inner layer.

4. The smoking article as claimed in claim 1, wherein one of the outer layer and the inner layer defines a slot, and the other of the outer layer and the inner layer is attached to a limiter element moveable within the slot to limit movement of the selection portion.

5. The smoking article as claimed in claim 1, wherein the selection portion of the outer layer is frangibly connected to a further part of the outer layer, and/or the underlying part of the inner layer is frangibly connected to a further part of the inner layer.

6. The smoking article as claimed in claim 1, wherein the inner layer comprises includes a first ventilation area, the outer layer comprises a second ventilation area movable relative to the first ventilation area, and an overlapping area of the first ventilation area and the second ventilation area determines a ventilation of the smoking article.

7. The smoking article as claimed in claim 4, wherein the inner layer includes a first ventilation area, the outer layer includes a second ventilation area movable relative to the first ventilation area, and an overlapping area of the first ventilation area and the second ventilation area determines a ventilation of the smoking article, wherein the slot defines one of the first ventilation area or the second ventilation area.

8. The smoking article as claimed in claim 1, wherein the outer layer includes a forward part and a rearward part longitudinally rearward of the forward part, the selection portion disposed at an interface between the forward part and the rearward part.

9. The smoking article as claimed in claim 8, wherein the forward part is frangibly connected to the rearward part and configured to detach from the rearward part on application of a force.

10. The smoking article as claimed in claim 1, further comprising an indexing mechanism configured to index movement between the outer layer and the one or more rod articles.

11. A smoking article assembly for forming two smoking articles, the smoking article assembly comprising:

rod articles for forming the smoking articles;

an inner layer disposed around the rod articles; and an outer layer disposed around the inner layer, wherein the inner and outer layers are integrally formed, the outer layer including a selection portion for each smoking article, each said selection portion configured to move over a corresponding underlying part of the inner layer to select a property of a smoking article, the smoking article assembly configured to be cut into two separate smoking articles.

12. The smoking article assembly as claimed in claim 11, wherein the inner and outer layers are configured such that the selection portion for each of the two smoking articles is rotatable in a same sense on each of the two separate smoking articles, once separated.

13. The smoking article assembly as claimed in claim 11, wherein at least one selection portion of the outer layer defines a cut-out area adjacent to the inner layer, wherein said cut-out area is configured such that the selection portion is movable towards the inner layer from an initial position.

14. The smoking article assembly as claimed in claim 11, further comprising a limiter for each smoking article, configured to limit movement of the corresponding selection portion, wherein each said limiter couples the corresponding selection portion for the respective smoking article to the corresponding underlying part of the inner layer, and is configured such that the selection portion for each of the two smoking articles is rotatable in a same sense on the two separate smoking articles, once separated.

15. The smoking article assembly as claimed in claim 14, wherein each limiter of each of the two separate smoking articles, once separated, comprises:

a slot on one of the outer layer and the inner layer, and a limiter element, attached to the other of the outer layer and the inner layer and located within the slot, the limiter element moveable to limit movement of the corresponding selection portion, wherein the limiter element is initially disposed, at an end of its corresponding slot and arranged such that the two smoking articles are rotatable in a same sense when separated.

16. A blank for wrapping around one or more rod articles to form a smoking article, the blank comprising:

a first area configured to form an inner layer extending around one or more rod articles, a second area configured to form an outer layer extending around the inner layer, wherein the first and second areas are integrally formed, and the second area defines a selection portion configured to move over an underlying part of the inner layer to select a property of a smoking article.

17. The blank as claimed in claim 16, wherein the selection portion of the second area defines a cut-out area adjacent to the first area and configured such that the selection portion is movable towards the inner layer from an initial position when wrapped around the rod articles.

18. The blank as claimed in claim 16, wherein the blank is configured to wrap around the one or more rod articles to form two smoking articles, the first area includes a selection portion, for each smoking article, configured to move over a corresponding underlying part of the inner layer to select a property of the corresponding smoking article, and the blank is configured to be cut into two sections to define two separate smoking articles.

19. The blank as claimed in claim 18, further comprising a limiter configured to limit movement of the selection portion of each smoking article, wherein the limiter is configured to couple the selection portion of each smoking article to the corresponding underlying part of the inner layer, and the limiter is configured such that the selection portion of each of the two smoking articles is rotatable in a same sense on the two smoking articles, once assembled and separated.

20. The blank as claimed in claim 19, wherein the limiter comprises:

a slot on one of the outer layer and the inner layer for each smoking article, and a limiter element attached to the other of the outer layer and the inner layer, configured to be located within the slot for each smoking article and moveable to limit movement of the corresponding selection portion, wherein the limiter element is configured to be initially disposed at an end of its corresponding slot and configured such that the two smoking articles are rotatable in a same sense on the two smoking articles, once assembled and separated.

21. A method of manufacturing a smoking article, the method comprising:

providing one or more rod articles, wrapping a blank around the one or more rod articles, to form an inner layer extending around the one or more rod articles, and to form an outer layer extending around the inner layer such that the inner and outer layers are integrally formed, wherein the outer layer includes a selection portion configured to move over an underlying part of the inner layer to select a property of a smoking article.

22. The method as claimed in claim 21, wherein the providing one or more rod articles includes providing rod articles for forming two smoking articles and the blank defines a selection portion for each smoking article, the method further comprising cutting the wrapped blank to form two separate smoking articles.

* * * * *